US006551150B2

(12) United States Patent
Machado

(10) Patent No.: US 6,551,150 B2
(45) **Date of Patent: *Apr. 22, 2003**

(54) GLASS MOUNTED ELECTRICAL TERMINAL

(75) Inventor: Manuel Machado, Hope, RI (US)

(73) Assignee: Antaya Technologies Corporation, Cranston, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/118,550

(22) Filed: Apr. 8, 2002

(65) Prior Publication Data

US 2002/0111081 A1 Aug. 15, 2002

Related U.S. Application Data

(63) Continuation of application No. 09/671,035, filed on Sep. 27, 2000, now Pat. No. 6,406,337.

(51) Int. Cl.[7] ..... H01R 4/02
(52) U.S. Cl. ..... 439/876
(58) Field of Search ..... 439/874, 876; 174/84 C; 219/522, 543; 343/713

(56) References Cited

U.S. PATENT DOCUMENTS

| | | | | |
|---|---|---|---|---|
| 2,709,211 A | | 5/1955 | Glynn | 201/63 |
| 2,787,693 A | | 4/1957 | Razlag | 219/19 |
| RE25,591 E | | 6/1964 | Swengel | 439/855 |
| 3,383,457 A | | 5/1968 | Schumacher et al. | |
| 3,534,148 A | | 10/1970 | Bange | 219/543 |
| 3,634,654 A | * | 1/1972 | Peetz | |
| 3,743,748 A | | 7/1973 | Reeder | 174/75 C |
| 3,981,556 A | | 9/1976 | Sabatelli et al. | 339/275 |
| 4,023,008 A | | 5/1977 | Durussel | 219/522 |
| 4,141,011 A | * | 2/1979 | Boaz | 343/713 |
| 4,415,196 A | | 11/1983 | Baum et al. | 296/201 |
| 4,425,021 A | | 1/1984 | Nicolino | 339/275 |
| 4,449,165 A | * | 5/1984 | Kaufman | |
| 4,938,708 A | * | 7/1990 | Vigneau et al. | 439/239 |
| 5,268,700 A | | 12/1993 | Hirotsu et al. | 343/713 |
| 5,357,074 A | | 10/1994 | Pawlikowski | 219/85.18 |
| 5,631,806 A | | 5/1997 | Fried et al. | 361/773 |
| 5,879,206 A | | 3/1999 | Badgley et al. | 439/876 |
| 5,928,455 A | | 7/1999 | Dizin et al. | 156/276 |
| 5,961,348 A | * | 10/1999 | Murphy | 439/579 |
| 6,039,616 A | | 3/2000 | Pereira et al. | 439/874 |
| 6,406,337 B1 | * | 6/2002 | Machado | 439/876 |

OTHER PUBLICATIONS

IBM Technical Disclosure Bulletin, vol. 33, No. 1B, p. 478, (1990).

* cited by examiner

*Primary Examiner*—Neil Abrams
(74) *Attorney, Agent, or Firm*—Hamilton, Brook, Smith & Reynolds, P.C.

(57) ABSTRACT

An electrical terminal including a base pad for soldering to a surface. The base pad has a curved perimeter, and top and bottom surfaces. The electrical terminal also includes a securement portion having a deformable member for deforming around a conductor wire to capture and secure the conductor wire directly to the securement portion. The securement portion is configured relative to the base pad such that forces exerted by the conductor on the base pad are directed to a central region of the base pad.

20 Claims, 6 Drawing Sheets

GLASS MOUNTED ELECTRICAL TERMINAL

RELATED APPLICATION

This application is a continuation of U.S. application Ser. No. 09/671,035, filed Sep. 27, 2000, now U.S. Pat. No. 6,406,337, issued Jun. 18, 2002, the entire teachings of which are incorporated herein by reference.

BACKGROUND

The windshield and/or rear window of automotive vehicles often have an electrical device such as an antenna or defroster formed on or in the glass. In order to electrically connect the electrical device to associated equipment, for example, a radio, telephone, or defroster control, an electrical terminal is first soldered to the glass in electrical communication with the electrical device. An electrical cable extending from the associated equipment is then secured to the electrical terminal for providing electrical communication therebetween. A problem with some current electrical terminals is that the terminals can be easily separated from the glass by peeling if accidental pulling forces are exerted on the electrical cable. In addition, some electrical terminal designs are prone to cause cracking of the glass during soldering because of heat related stress concentrations formed on the glass by the footprint of the terminal.

SUMMARY

The present invention provides an electrical terminal which is less readily separated from glass by accidental pulling forces than current terminal designs. In addition, the present invention electrical terminal has a design which causes little or no cracking of glass during soldering. The present invention is directed to an electrical terminal which includes a base pad for soldering to a surface. The base pad has a curved perimeter, and top and bottom surfaces. The electrical terminal also includes a securement portion having a deformable member for deforming around a conductor wire to capture and secure the conductor wire directly to the securement portion. The securement portion is configured relative to the base pad such that forces exerted by the conductor on the base pad are directed to a central region of the base pad.

In preferred embodiments, the base pad is formed of sheet metal and is generally circular in shape. The bottom surface of the base pad has a layer of solder thereon. In one embodiment, the securement portion includes a deformable strap located at the central region of the base pad formed by two opposed slits in the base pad. The slits allow the insertion of the conductor wire therethrough for capture between the top surface of the base pad and the strap.

In another embodiment, the securement portion includes an arm having proximal and distal ends extending from the central region of the base pad for directing forces exerted by the conductor wire to the central region. The proximal end extends from the central region and is defined by two opposed slots formed in the base pad extending from the perimeter of the base pad to the central region. The distal end has opposed crimping tabs for securing directly to the conductor wire. A portion of the arm is bent upwardly at an angle at about the perimeter of the base pad for absorbing forces exerted on the arm by the conductor wire. The distal end of the arm is bent to be parallel with the base pad.

The present invention also provides an electrical terminal assembly which enables easy soldering of multiple terminals with proper spacing therebetween. The terminal assembly includes at least two terminals, each having a base pad for soldering to a surface. Each base pad is secured to a conductor wire. A carrier strip is attached to the base pads by breakable regions.

The present invention further provides a method of soldering multiple electrical terminals to a surface, including providing an electrical terminal assembly having at least two terminals, each having a base pad for soldering to the surface. The base pads are secured to respective conductor wires and are attached to a carrier strip by breakable regions. The base pads are soldered to the surface with the carrier strip providing the proper spacing between the base pads. Once the base pads are soldered, the carrier strip is separated from the base pads by bending the carrier strip upwardly, thereby breaking the breakable regions.

In the present invention electrical terminal, by directing forces exerted by the conductor to the central region of the base pad, the strength of the solder joint between the base pad and the underlying surface, typically glass, is maximized. As a result, the terminal is not readily separated from the glass by accidental pulling forces. In addition, by having a generally circular base pad, the base pad of the present invention forms little or no heat related stress concentrations on the glass during soldering so that little or no cracking of the glass occurs. Consequently, the present invention provides a terminal that may be soldered to glass in a reliable manner and remain soldered thereto during normal use. Finally, the present invention electrical terminal assembly allows multiple electrical terminals to be quickly and easily soldered with the proper spacing therebetween, thereby allowing the manufacturing process to be conducted more quickly.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
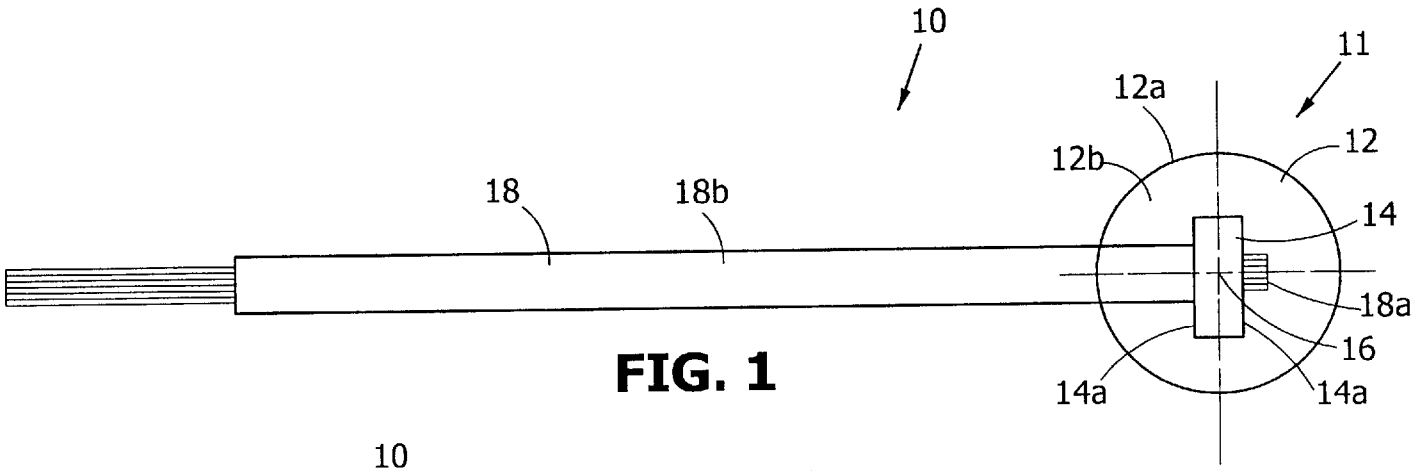
FIG. 1 is a plan view of an embodiment of the present invention electrical terminal which is secured to an electrical cable.
Figure 2:
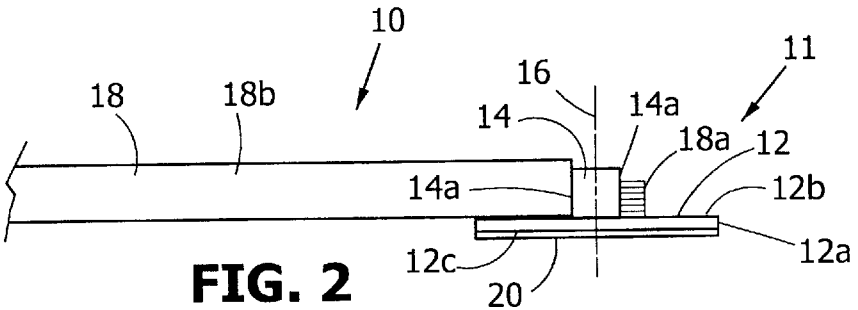
FIG. 2 is a side view of the electrical terminal of FIG. 1.

Referring to FIGS. 1 and 2, terminal 11 is an electrical terminal that is typically soldered to the windshield or rear window of an automotive vehicle in electrical communication with an electrical device, such as an antenna or defroster formed on or in the glass, so that the electrical device may be electrically connected to associated equipment by an electrical cable 18. Electrical terminal 11 includes a generally flat or planar base pad 12 formed of sheet metal having a continuously curved outer perimeter or edge 12*a*. Typically, base pad 12 is generally circular in shape (FIG. 1). The bottom surface 12*c* of base pad 12 is precoated with a layer of solder (FIG. 2) for facilitating the soldering process. Two parallel slits 14*a* in the central region of base pad 12, made by lancing, form a deflectable or deformable strap 14. The strap 14 is centrally located relative to base pad 12. This allows the inner conductor wire 18*a* of electrical cable 18 which extends beyond the outer insulation 18*b* to be inserted through the slits 14*a* and under strap 14 for assembly to base pad 12. The diameter of the conductor wire 18*a* pushes and deforms the strap 14 slightly upwardly relative to base pad 12 so that the strap 14 extends around the top surfaces of conductor wire 18*a*. The conductor wire 18*a* is thereby captured or pinched between the strap 14 and the top surface 12*b* of base pad 12. The electrical terminal 11 and the cable 18 are typically preassembled in a cable/terminal assembly 10 before soldering.

Figure 3:
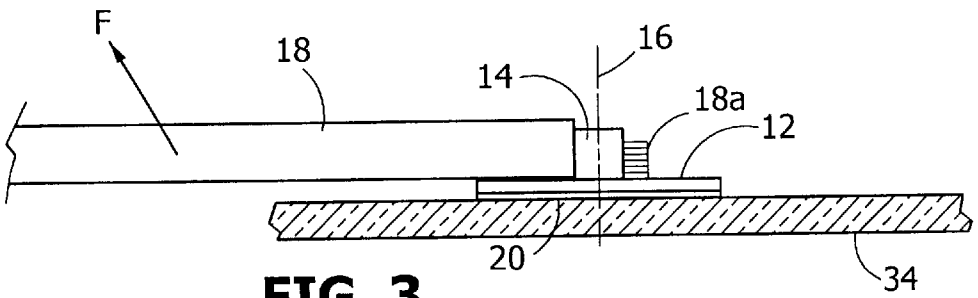
FIG. 3 is a side view of the electrical terminal of FIG. 1 soldered to a piece of glass.

In use, electrical terminal 11 is typically soldered to glass 34 (FIG. 3) by positioning terminal 11 in the desired position on the glass 34, usually a metallic terminal pad coated on the glass 34, and heating base pad 12 to melt the layer of solder 20 on the bottom 12*c* of base pad 12. The solder 20 bonds base pad 12 to glass 34 as well as bonds conductor wire 18*a* to both the base pad 12 and the glass 34. The curved outer perimeter 12*a* of the circular base pad 12 has no sharp corners and, as a result, forms little or no heat related stress concentrations on the glass during soldering. Typically, such stress concentrations, if formed, tend to cause cracks in the glass. Consequently, little or no cracking of the glass 34 occurs when electrical terminal 11 is soldered thereto.

Once terminal 11 is soldered to glass 34, any accidental pulling forces F (FIG. 3) exerted on electrical cable 18 are transferred to about the center 16 of base pad 12 because the inner conductor 18*a* of cable 18 is secured to base pad 12 at the center 16. This maximizes the ability of terminal 11 to resist separating from the glass 34 due to accidental pulling of cable 18. The reason for this is that a greater pulling force is required to pull terminal 11 from glass 34 when directed at the center 16 than if directed at the perimeter 12*a*, for example, if cable 18 were secured to base pad 12 near the perimeter 12*a*. A pulling force directed at the perimeter 12*a*would separate the base pad 12 from the glass 34 by first lifting an edge from the glass 34 and then progressively peeling the base pad 12 from the glass 34. As a result, an edge directed pulling force does not act on the whole solder joint at once, but instead is directed on a small area along the moving peel line. Only a portion of the solder joint is acted upon by the pulling force at a particular time. In contrast, by securing cable 18 to the center 16 of base pad 12 and directing pulling forces F to the center 16 of base pad 12 rather than to the perimeter 12*a*, the pulling forces F do not lift an edge of base pad 12 in a peeling type action. Consequently, the centrally directed pulling forces F at any particular moment in time are resisted by the entire solder joint which makes it more difficult to pull base pad 12 from the glass 34.

Figure 4:
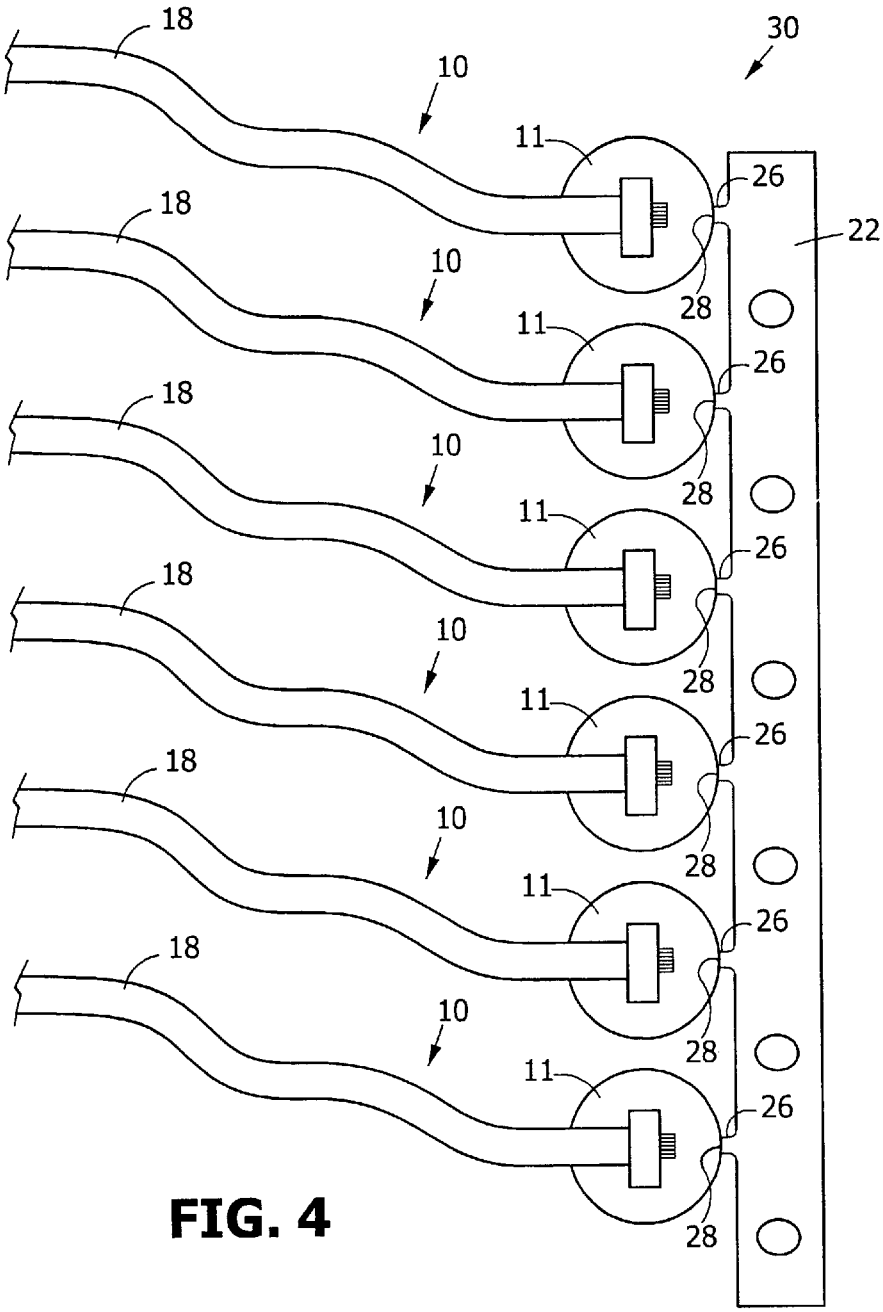
FIG. 4 is a plan view of a multiple terminal soldering assembly having a series of electrical terminals attached to a carrier strip which are secured to electrical cables.

A more detailed description of terminal 11 now follows. As shown in FIG. 1, base pad 12 is preferably circular. Slits 14*a* are formed through base pad 12 on opposite sides of the center 16 of base pad 12. Slits 14*a* extend parallel to each other across the central region of base pad 12 on either side of center 16, and terminate about halfway between the center 16 and the outer perimeter 12*a*. Terminal 11 is formed in a stamping and forming process by a forming die having a succession of progressive stations. Typically, the forming process produces a series of terminals 11 which are attached to a continuous carrier strip 22. FIG. 4 depicts a section of such a configuration. The cables 18 may be attached when the terminals 11 are formed, or at a later time.

In one embodiment, base pad 12 is formed of C260 brass and is about 8 mm in diameter by 0.318 mm thick. Base pad 12 is tempered ½ hard about 0.22 mm thick. Slits 14*a* are about 4 mm long and are located 1.5 mm apart from each other. Solder 20 is about 0.305 mm thick and contains about 25% Sn (tin), 62% Pb (lead), 10% Bi (bismuth) and 3% Ag (silver). Alternatively, solder 20 may contain about 30% Sn, 65% In (indium), 0.5% Cu (copper) and 4.5% Ag. The elements and percentages of solder 20 may be additionally varied to suit the situation at hand. Base pad 12 may also be formed of other suitable conductive metals such as copper or bronze. In addition, the length and spacing between slits 14*a* may be varied to accommodate different diameter conductor wires 18*a*. Furthermore, the diameter and thickness of base pad 12 may be varied to suit different applications.

Figure 5:
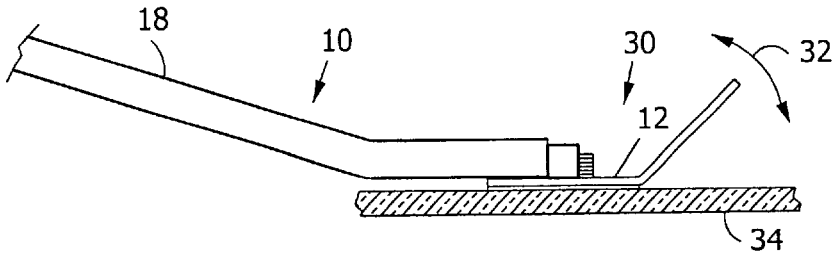
FIG. 5 is a side view of the multiple terminal soldering assembly soldered to a piece of glass.

Referring to FIGS. 4 and 5, multiple terminal soldering assembly 30 includes a series of cable/terminal assemblies 10 which are attached to a carrier strip 22 by a series of breakable regions 26. In use, the soldering assembly 30 is placed upon the glass 34 in the desired location. The cable/terminal assemblies 10 are then soldered to the glass 34 while still attached to the carrier strip 22. The cable/terminal assemblies 10 are attached to carrier strip 22 at the same distance apart from each other that is required when soldered on the glass 34. Consequently, proper spacing of the terminals 11 on the glass 34 is consistently achieved. Once the terminals 11 are soldered to the glass 34, the carrier strip 22 is separated from the terminals 11 by bending the carrier strip 22 upwardly and downwardly in the direction indicated by arrow 32 (FIG. 5) until the breakable regions 26 break along lines 28. Thus, multiple cable/terminal assemblies 10 are quickly and easily soldered to glass 34 with the proper spacing therebetween.

Since terminals 11 are typically attached to carrier strip 22 when formed, the formation of soldering assembly 30 subsequently only requires attaching the electrical cables 18 to the terminals 11 and cutting the carrier strip 22 to a length that contains the desired number of terminals 11. The spacing of terminals 11 relative to each other on carrier strip 22 may be selected to suit particular applications. Although six cable/terminal assemblies 10 are shown attached to carrier strip 22 in FIG. 4, any number of cable/terminal assemblies 10 may be employed depending upon the application at hand. Typically, carrier strip 22 is attached to at least two cable/terminal assemblies 10.

Figure 6:
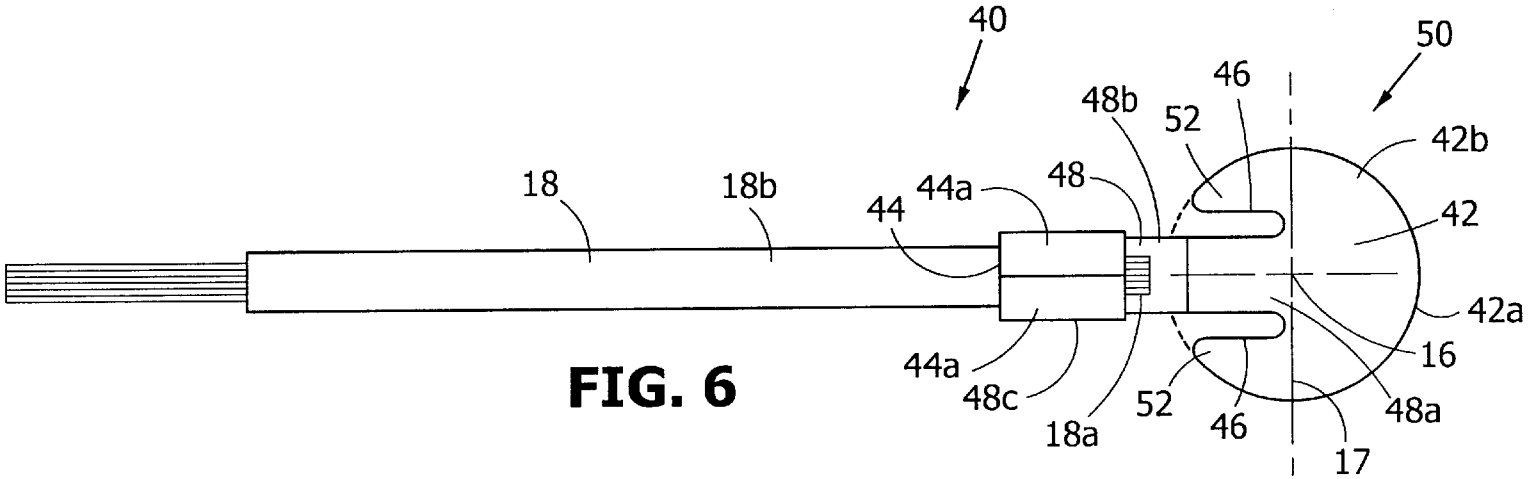
FIG. 6 is a plan view of another embodiment of the present invention electrical terminal which is secured to an electrical cable.
Figure 7:
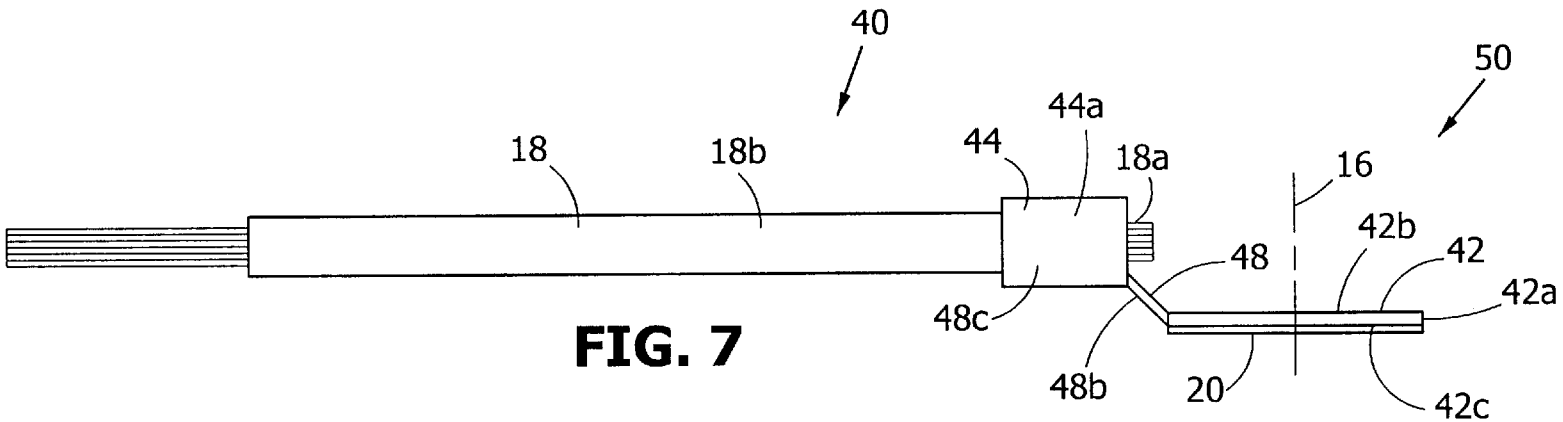
FIG. 7 is a side view of the electrical terminal of FIG. 6.

Referring to FIGS. 6 and 7, electrical terminal 50 is another embodiment of the present invention. Terminal 50 may be preassembled with an electrical cable 18 to form a cable/terminal assembly 40. Terminal 50 has a base pad 42 that is generally or substantially circular in shape. The outer perimeter or edge 42*a* of base pad extends continuously in a circular manner for about 270° before being interrupted by an arm 48 having a proximal end 48*a* extending from the center 16 of base pad 42 and which is defined by a pair of parallel slots 46 formed within base pad 42 (FIG. 6). Arm 48 extends beyond the outer perimeter 42*a* of base pad 42 for crimping to cable 18. The slots 46 extend from the outer perimeter 42, inwardly about halfway to the center line 17 of base pad 42, thereby forming two wings 52 thereof. The arm 48 has an intermediate portion 48*b* which is bent upwardly at an angle from the proximal end 48*a* at about the outer perimeter 42*a*. The distal end 48*c* of arm 48 includes a crimping portion 44 having two opposed crimping tabs 44*a* for crimping to the inner conductor wire 18*a* of cable 18. Arm 48 is bent between the intermediate portion 48*b* and the distal end 48*c* so that the distal end 48*c* is positioned parallel to and laterally offset from the base pad 42 as well as above the top surface 42*b*. A layer of solder 20 coats the bottom surface 42*c* of base pad 42.

Figure 8:
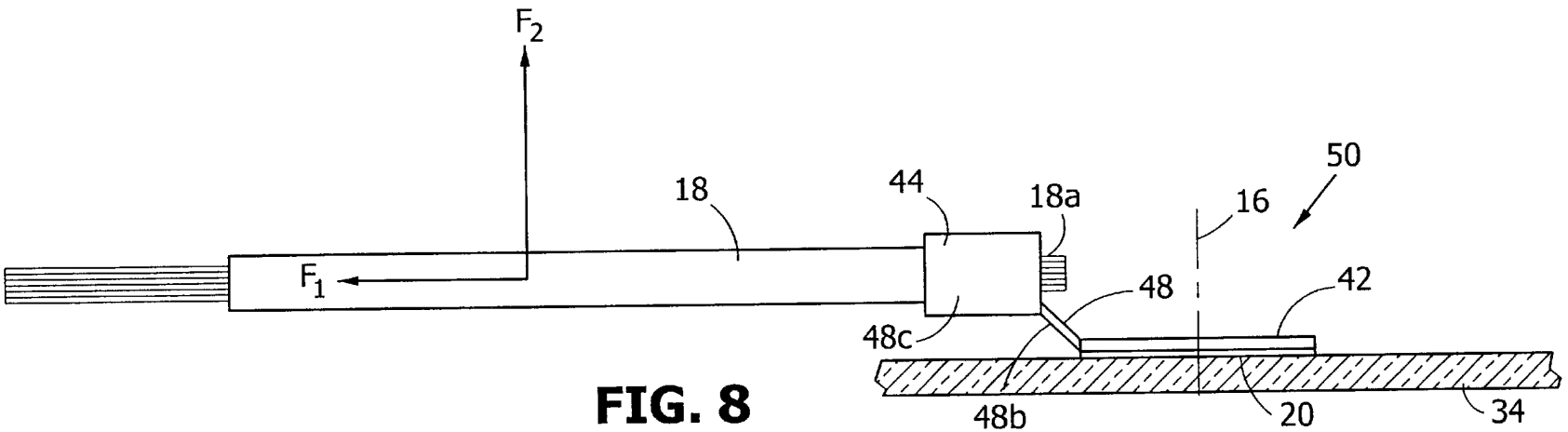
FIG. 8 is a side view of the electrical terminal of FIG. 6 soldered to a piece of glass.

In use, referring to FIG. 8, terminal 50 is soldered to glass 34 in a manner similar to terminal 11. As with terminal 11, base pad 42 is generally circular in shape (FIG. 6) and does not tend to cause heat related stress concentrations in glass 34, and therefore, little or no cracking occurs. The proximal portion 48*a* of arm 48 lies along the same plane (FIG. 8) as the rest of base pad 42 such that slots 46 provide only minor interruptions in the circular shape of base pad 42. Consequently, with regard to heat transfer from terminal 50 to glass 34, base pad 42 is effectively circular in shape as shown by the dotted lines (FIG. 6) despite slots 46. Once soldered, any accidental pulling forces $F_1/F_2$ on cable 18 (FIG. 8) are transferred to the center 16 of base pad 42 because the proximal end 48*a* of arm 48 extends therefrom. Consequently, terminal 50 is resistant to being separated from glass 34 in a similar manner as with terminal 11. In addition, the upwardly angled intermediate portion 48*b* at arm 48 is able to bend or deflect thereby absorbing forces exerted on terminal 50 by cable 18. This may lessen the intensity of forces $F_1/F_2$ exerted on base pad 42 by accidental pulling of cable 18. For example, if a longitudinal pulling force $F_1$was exerted on cable 18, intermediate portion 48*b* would bend slightly to the left and absorb some of the force. In addition, if an upward pulling force $F_2$ was exerted on cable 18, intermediate portion 48*b* would bend slightly upwardly and absorb some of the force. The angled intermediate portion 48*b* is also able to absorb forces that are in the opposite direction of forces $F_1$ and $F_2$, for example, forwardly and downwardly directed forces. Furthermore, the proximal end 48*a* of arm may also bend or deflect to absorb forces.

In one embodiment, terminal 50 is formed of C260 brass and is about 8 mm in diameter by 0.381 mm thick. Base pad 12 is tempered ½ hard about 0.22 mm thick. Terminal 50 is about 13 mm in length. Slots 46 are about 8 mm wide and are spaced apart from each other to form a proximal end 48*a* of arm 48 that is about 2.5 mm wide. Intermediate portion 48*b* is bent at about a 45° angle to provide equal force absorbing capabilities for longitudinal and vertical forces. The distal end 48*c* is bent to be above the proximal end 48*a* about 1.5 mm. The crimping tabs 44 are about 4 mm wide. The same solder 20 used with terminal 11 may be employed with base pad 42. As with terminal 11, the dimensions of terminal 50 may be varied to suit particular circumstances. Although intermediate portion 48*b* is preferably bent, alternatively, intermediate portion 48*b* may be straight. In addition, the proximal end 48*a* may be bent instead of intermediate portion 48*b*.

Figure 9:
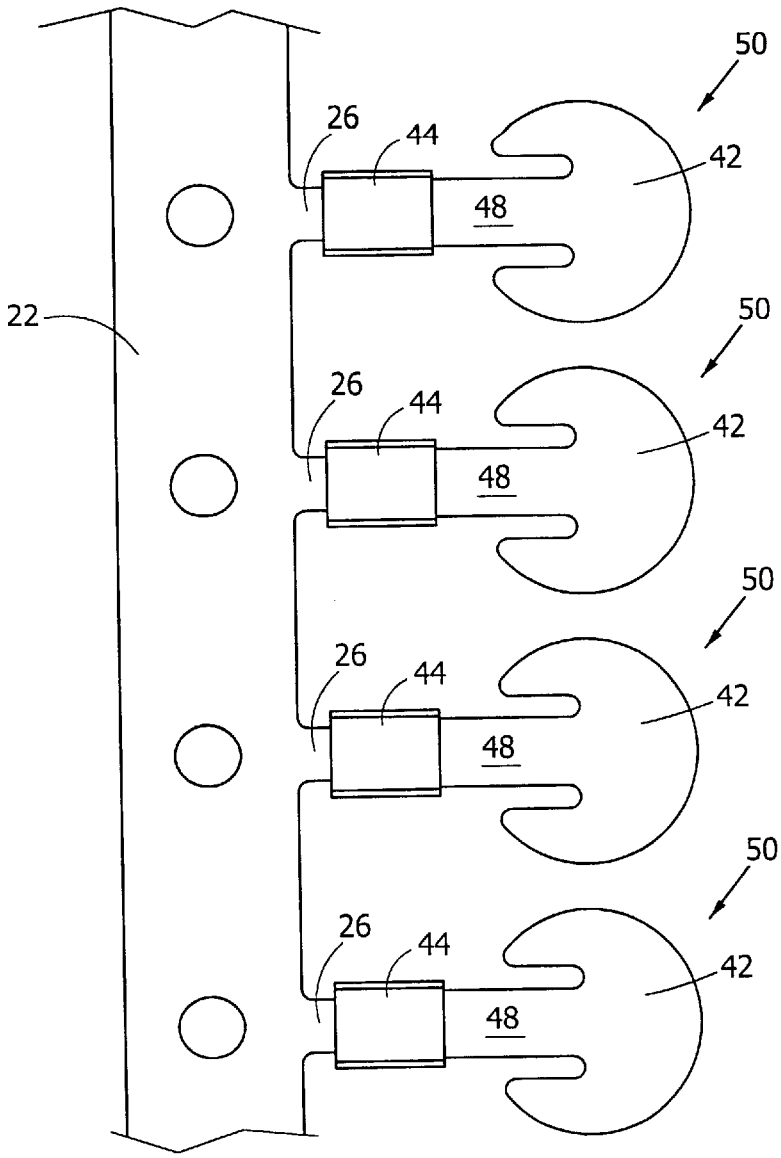
FIGS. 9 and 10 are plan and side views, respectively, of a series of the electrical terminals of FIG. 6 which are attached to a carrier strip.
Figure 10:
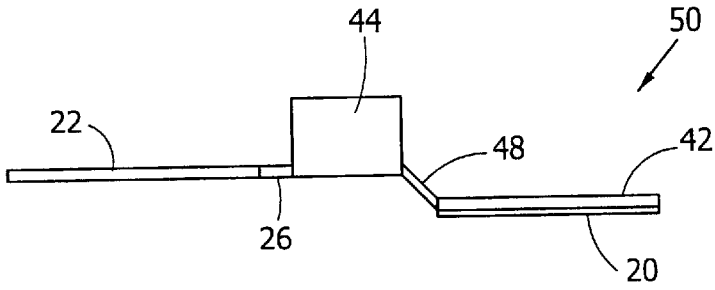

Terminal 50 is formed by a stamping and forming process in a similar manner as with terminal 11. As seen in FIGS. 9 and 10, after being formed, terminals 50 are attached to a carrier strip 22 by breakable regions 26 extending from crimping portion 44. The carrier strip 22 may be cut into sections in similar fashion to that shown in FIGS. 4 and 5 to form a multiple terminal soldering assembly, so that multiple terminals 50 may be soldered to glass 34 at the same time. Cables 18 may be crimped to terminals 50 before soldering.

Figure 11:
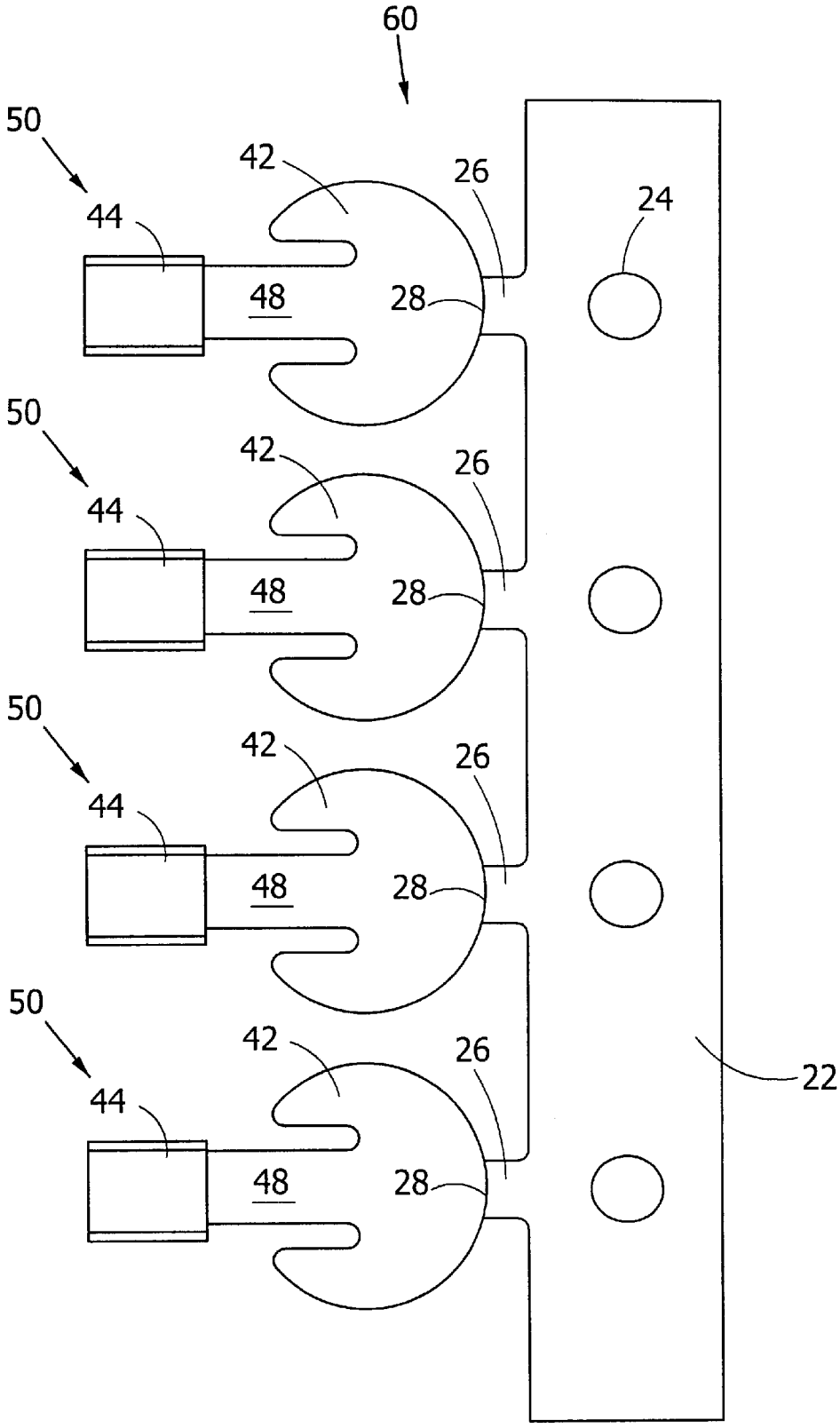
FIG. 11 is a plan view of another multiple terminal assembly.

FIG. 11 depicts another configuration of a multiple terminal soldering assembly 60 where terminals 50 are attached to the carrier strip 22 by breakable regions 26 extending from the base pad 42 instead of from crimping portion 44. Cables 18 may be also crimped to terminals 50 before soldering.

While this invention has been particularly shown and described with references to preferred embodiments thereof, it will be understood by those skilled in the art that various changes in form and details may be made therein without departing from the scope of the invention encompassed by the appended claims.

For example, although particular terms have been used to describe the present invention such as upwardly, downwardly, forwardly, etc., these terms are not meant to limit the orientation of the present invention terminal. In addition, although the base pads 12 and 42 are preferably generally circular in shape, base pads 12/42 may be generally oval, or may be other suitable curved shapes which do not have sharp corners. Such curved shapes may include linear perimeter portions. Furthermore, although base pads 12/42 have been depicted as generally flat or planar, alternatively, the base pads may have contoured bottoms for mating with contoured surfaces such as a curved surface. Solder layer 20 may be omitted if desired. Also, the present invention terminal may be soldered to surfaces other than glass.

What is claimed is:

1. An electrical terminal comprising:

a base pad for soldering to a surface, the base pad having a perimeter, and top and bottom surfaces;

a securement portion for securing to a conductor, the securement portion being configured relative to the base pad such that forces exerted by the conductor on the base pad are directed to a central region of the base pad, the securement portion including a deformable strap located at the central region of the base pad formed by two opposed slits in the base pad, the slits allowing the insertion of the conductor therethrough for capture between the top surface of the base pad and the strap, the terminal being formed in a planar configuration, whereby insertion of the conductor causes deformation of the deformable strap upwardly from the base pad.

2. The terminal of claim 1 in which the slits extend across the central region of the base pad and terminate before reaching the perimeter.

3. The terminal of claim 2 in which the slits are parallel to each other.

4. The terminal of claim 1 further comprising a layer of solder on the bottom surface of the base pad.

5. The terminal of claim 1 in which the base pad is formed of sheet metal.

6. An electrical terminal comprising:

a base pad for soldering to a surface, the base pad having a curved perimeter that is generally circular in shape, and top and bottom surfaces;

a securement portion for connecting to a conductor, the securement portion including an arm having proximal and distal ends extending from a central region of the base pad for directing forces exerted by the conductor on the base pad to the central region of the base pad, the proximal end extending from the central region and being defined by two opposed slots formed in the base pad extending from the perimeter of the base pad to the central region, the proximal end of the arm lying along a common plane with the base pad to about the outer perimeter of the base pad, the arm being bent upwardly at an angle at about the perimeter of the base pad to form an intermediate portion and the distal end of the arm being bent to be parallel with the base pad.

7. The terminal of claim 6 in which a portion of the arm is bent upwardly at an angle for absorbing forces exerted on the arm by the conductor.

8. The terminal of claim 6 further comprising a layer of solder on the bottom surface of the base pad.

9. The terminal of claim 6 in which the base pad is formed of sheet metal.

10. An electrical terminal assembly comprising:

at least two cable/terminal assemblies each having a terminal with a base pad for soldering to a surface and a securement portion, the base pad having a perimeter, and top and bottom surfaces, the securement portion for securing to a conductor of a cable, the securement portion being configured relative to the base pad such that forces exerted by the conductor on the base pad are directed to a central region of the base pad, the securement portion including a deformable strap located at the central region of the base pad formed by two opposed slits in the base pad, the slits allowing the insertion of the conductor therethrough for capture between the top surface of the base pad and the strap, each terminal being secured to a respective cable, the terminal being formed in a planar configuration, whereby insertion of the conductor causes deformation of the deformable strap upwardly from the base pad; and a carrier strip attached to the base pads of the cable/terminal assemblies by breakable regions.

11. An electrical terminal assembly comprising:

at least two cable/terminal assemblies each having a terminal with a generally circular base pad for soldering to a surface and a securement portion, the base pad having a perimeter, and top and bottom surfaces, the securement portion including an arm having proximal and distal ends extending from a central region of the base pad for directing forces exerted by the conductor on the base pad to the central region of the base pad, the proximal end extending from the central region and being defined by two opposed slots formed in the base pad extending from the perimeter of the base pad to the central region, each terminal being secured to a respective cable, the proximal end of the arm lying along a common plane with the base pad to about the outer perimeter of the base pad, the arm being bent upwardly at an angle at about the perimeter of the base pad to form an intermediate portion and the distal end of the arm being bent to be parallel with the base pad; and a carrier strip attached to the base pads of the cable/terminal assemblies by breakable regions.

12. A method of forming an electrical terminal comprising the steps of:

providing a base pad for soldering to a surface, the base pad having a perimeter, and top and bottom surfaces;

forming a securement portion for securing to a conductor, the securement portion being configured relative to the base pad such that forces exerted by the conductor on the base pad are directed to a central region of the base pad; and providing the securement portion with a deformable strap located at the central region of the base pad formed by two opposed slits in the base pad, the slits allowing the insertion of the conductor therethrough for capture between the top surface of the base pad and the strap, the terminal being formed in a planar configuration, whereby insertion of the conductor causes deformation of the deformable strap upwardly from the base pad.

13. The method of claim 12 further comprising extending the slits across the central region of the base pad, the slits terminating before reaching the perimeter.

14. The method of claim 13 further comprising extending the slits parallel to each other.

15. The method of claim 12 further comprising forming a layer of solder on the bottom surface of the base pad.

16. The method of claim 12 further comprising forming the base pad from sheet metal.

17. A method of forming an electrical terminal comprising the steps of:

providing a base pad for soldering to a surface, the base pad having a perimeter that is generally circular in shape, and top and bottom surfaces;

forming a securement portion for connecting to a conductor; and providing the securement portion with an arm having proximal and distal ends extending from a central region of the base pad for directing forces exerted by the conductor on the base pad to the central region of the base pad, the proximal end extending from the central region and being defined by two opposed slots formed in the base pad extending from the perimeter of the base pad to the central region, the proximal end of the arm lying along a common plane with the base pad to about the outer perimeter of the base pad, the arm being bent upwardly at an angle at about the perimeter of the base pad to form an intermediate portion and the distal end of the arm being bent to be parallel with the base pad.

18. The method of claim 17 further comprising the step of bending a portion of the arm upwardly at an angle for absorbing forces exerted on the arm by the conductor.

19. The method of claim 17 further comprising the step of providing a layer of solder on the bottom surface of the base pad.

20. The method of claim 17 further comprising the step of forming the base pad from sheet metal.

* * * * *